US012459552B2

(12) United States Patent
Feng et al.

(10) Patent No.: US 12,459,552 B2
(45) Date of Patent: Nov. 4, 2025

(54) URBAN RAIL TRANSPORTATION FUSION SIGNALING SYSTEM AND APPLICATION METHOD THEREOF

(71) Applicant: CASCO SIGNAL CO., LTD., Shanghai (CN)

(72) Inventors: Wei Feng, Shanghai (CN); Xiaoyong Wang, Shanghai (CN); Yanyang Xing, Shanghai (CN); Liang Pan, Shanghai (CN)

(73) Assignee: CASCO SIGNAL CO., LTD., Shanghai (CN)

( * ) Notice: Subject to any disclaimer, the term of this patent is extended or adjusted under 35 U.S.C. 154(b) by 236 days.

(21) Appl. No.: 18/021,355

(22) PCT Filed: Sep. 24, 2021

(86) PCT No.: PCT/CN2021/120057
§ 371 (c)(1),
(2) Date: Feb. 14, 2023

(87) PCT Pub. No.: WO2022/213554
PCT Pub. Date: Oct. 13, 2022

(65) Prior Publication Data

US 2023/0322282 A1 Oct. 12, 2023

(30) Foreign Application Priority Data

Apr. 6, 2021 (CN) ..... 202110367726.9

(51) Int. Cl.
*B61L 27/20* (2022.01)
*B61L 3/02* (2006.01)
(Continued)

(52) U.S. Cl.
CPC ..... *B61L 27/20* (2022.01); *B61L 3/02* (2013.01); *B61L 27/04* (2013.01); *B61L 27/16* (2022.01); *B61L 2027/204* (2022.01)

(58) Field of Classification Search
CPC ..... B61L 27/00; B61L 27/04; B61L 27/16; B61L 27/20; B61L 2027/204; B61L 99/002
See application file for complete search history.

(56) References Cited

U.S. PATENT DOCUMENTS

2020/0239051 A1 7/2020 Hammerl et al.

FOREIGN PATENT DOCUMENTS

CN 106672018 A 5/2017
CN 106741013 A 5/2017
(Continued)

OTHER PUBLICATIONS

Jin, CN 1096469435, machine translation (Year: 2019).*
(Continued)

*Primary Examiner* — Mark L. Greene
(74) *Attorney, Agent, or Firm* — Amster, Rothstein & Ebenstein LLP

(57) ABSTRACT

An urban rail transportation fusion signaling system and method. The fusion signaling system includes: an autonomous train supervision system, configured to send a train operation plan; a first wayside management system, operating under a Train Autonomous Circumambulate System (TACS) system and configured to generate line resource allocation information according to the train operation plan; a second wayside management system, operating under a Communications-Based Train Control (CBTC) system and configured to generate operation permission information according to the train operation plan; and a car controller, provided on a rail transportation train and configured to:
(Continued)

perform traffic control according to the line resource allocation information when the train is traveling under the TACS system; or perform traffic control according the operation permission information when the train is traveling under the CBTC system.

11 Claims, 5 Drawing Sheets

(51) Int. Cl.
*B61L 27/04* (2006.01)
*B61L 27/16* (2022.01)

(56) References Cited

FOREIGN PATENT DOCUMENTS

| | | | | | |
|---|---|---|---|---|---|
| CN | 107284471 | A | | 10/2017 | |
| CN | 108189869 | A | | 6/2018 | |
| CN | 109649435 | A | * | 4/2019 | ..... B61L 15/0018 |
| CN | 110126882 | A | * | 8/2019 | ..... B61L 15/0027 |
| CN | 110920694 | A | | 3/2020 | |
| CN | 111497905 | A | | 8/2020 | |
| CN | 111776013 | A | | 10/2020 | |
| CN | 112124377 | A | * | 12/2020 | ..... B61L 27/0038 |
| CN | 112519836 | A | | 3/2021 | |
| CN | 112960018 | A | | 6/2021 | |
| EP | 1552997 | A2 | | 7/2005 | |
| WO | 2016169735 | A1 | | 10/2016 | |

OTHER PUBLICATIONS

Wang, CN 110126882, machine translation (Year: 2019).*
Xu, CN 111497905, machine translation (Year: 2020).*
Guo, CN 112124377, machine translation (Year: 2020).*
China National Intellectual Property Administration, Search Report for China Patent Application No. 202110367726.9, Mar. 15, 2022, 3 pp., China.
China National Intellectual Property Administration (ISA/CN), International Search Report for PCT/CN2021/120057, Jan. 11, 2022, 2 pp., China.

* cited by examiner

URBAN RAIL TRANSPORTATION FUSION SIGNALING SYSTEM AND APPLICATION METHOD THEREOF

CROSS-REFERENCE TO RELATED APPLICATIONS

This application is a U.S. national stage entry under 35 U.S.C. § 371 of PCT International Patent Application No. PCT/CN2021/120057, filed Sep. 24, 2021, which claims priority to Chinese Patent Application No. CN 202110367726.9, filed Apr. 6, 2021, the contents of each of which are incorporated herein by reference in their entirety.

TECHNICAL FIELD

The present invention relates to the technical field of rail transportation, and in particular, to an urban rail transportation fusion signaling system and an application method thereof.

BACKGROUND

As a convenient way of transportation, urban rail transportation has many advantages such as large capacity, high efficiency, low energy consumption, convenient riding, safety and comfort. With the rapid development of cities, the energy crisis and environmental protection pressure are increasing, making urban rail transportation the preferred way of transportation for residents, and the frequent travel of residents between different destinations have brought up higher demands to the operational efficiency of urban rail transportation.

At present, most of the domestic urban rail transportation signaling systems use a conventional CBTC system (Communication Based-on Train Control, that is a communication based autonomous train control system), which is essentially a signaling system based on train-to-ground communication. The conventional CBTC system uses ground equipment as the core of train control. Since there are many ground equipment, the efficiency of train-to-ground communication is low, which, in other words, affects the operational efficiency of urban rail transportation to a certain extent. Compared with the conventional CBTC system, the TACS system (Train Autonomous Circumambulate System, that is a vehicle-to-vehicle communication based train autonomous operation system), as a representative of a new generation of signaling system, takes train active resource management and active blocking as its core, and realizes the function transfer of the wayside equipment to the train, which simplifies the wayside equipment, and the efficiency of train branching, merging and retracing has also been significantly improved, thereby greatly improving the operational efficiency of urban rail transportation. However, due to the different construction requirements and construction time of each operating line, the signaling system equipped with each operating line will be different, resulting in that each line cannot meet the long-term interoperability requirements. If the whole line is reconstructed, it will bring great cost.

SUMMARY

The purpose of the present invention is to provide an urban rail transportation fusion signaling system and its application method, which can realize traffic control of the train operating under two different systems with compatibility and interoperability, and can satisfy the operation requirements of the train under the two different systems.

In order to achieve the above object, the present invention is achieved through the following technical solutions:

An urban rail transportation fusion signaling system, comprising:

- an autonomous train supervision system, configured to send a train operation plan;
- a first wayside management system, operating under a TACS system and configured to generate line resource allocation information according to the train operation plan;
- a second wayside management system, operating under a CBTC system and configured to generate traffic permission information according to the train operation plan; and
- a car controller, provided on a rail transportation train and configured to: perform traffic control according to the line resource allocation information when the train is traveling under the TACS system; or perform traffic control according the traffic permission information when the train is traveling under the CBTC system.

Preferably, the autonomous train supervision system and the car controller operate normally under both the TACS system and the CBTC system.

Preferably, the first wayside management system includes:

- an object controller, configured to perform control and status information collection on a wayside equipment; and
- a wayside resource manager, configured to perform allocation and recovery of a line resource according to status information of the wayside equipment and the train operation plan.

Preferably, the second wayside management system includes:

- a computer interlocking, configured to perform control and status information collection on the wayside equipment; and
- a zone controller, configured to obtain a protection zone of the train according to location information of the train and the train operation plan, so as to generate the traffic permission information of the train.

Preferably, when the train is operating under the TACS system, the car controller is configured to: send a line resource allocation request to the wayside resource manager according to the location information of the train and the train operation plan, so as to obtain the line resource allocation information, and calculate a movement authorization of the train according to the line resource allocation information and location information of an adjacent vehicle, so as to perform traffic control on the train.

Preferably, when the train is operating under the CBTC system, the car controller is configured to: send the location information of the train to the zone controller, so as to obtain the traffic permission information, and

- calculate the movement authorization of the train according to the traffic permission information and the status information of the wayside equipment, so as to perform traffic control on the train.

Preferably, the urban rail transportation fusion signaling system further includes: a centralized maintenance system, wherein the centralized maintenance system is configured to perform status supervising and maintenance on the autonomous train supervision system, the first wayside management system, the second wayside management system and the car controller, and the centralized maintenance system operates normally under both the TACS system and the CBTC system.

Preferably, the first wayside management system further includes: a wayside train manager, and the wayside train manager is configured to temporarily limit the speed of the train; and the second wayside management system further includes: a line controller; and the line controller is configured to temporarily limit the speed of the train.

Preferably, when the train operates under the TACS system, the autonomous train supervision system, the car controller, the centralized maintenance system, and the object controller, the wayside resource manager and the wayside train manager of the first wayside management system are interconnected through a data communication system; and when the train operates under the CBTC system, the autonomous train supervision system, the car controller, the centralized maintenance system, and the computer interlocking, the zone controller and the line controller of the second wayside management system are interconnected through the data communication system.

In another aspect, an application method for using an urban rail transportation fusion signaling system is further provided in the present invention, including:

providing the urban rail transportation fusion signaling system described above;

dividing a track where the train operates into a CBTC system zone and a TACS system zone;

deploying the urban rail transportation fusion signaling system in the CBTC system zone or the TACS system zone;

providing a transition zone between the CBTC system zone and the TACS system zone;

arranging at least three transponders at intervals in the transition zone; and switching the system by the car controller according to information of the transponder, so as to enable cross-zone operation of the train between the CBTC system zone and the TACS system zone.

Preferably, when the urban rail transportation fusion signaling system is deployed in the TACS system zone, the switching the system by the car controller according to information of the transponder includes the steps of:

allowing the train to operate under the CBTC system from the CBTC system zone to the transition zone;

respectively connecting the car controller with a first wayside management system and an adjacent vehicle in the TACS system zone through a data communication system according to information of the first transponder, so as to obtain line resource allocation information and location information of the adjacent vehicle;

calculating, by the car controller, a movement authorization of the train according to the line resource allocation information and the location information of the adjacent vehicle, so as to perform traffic control on the train;

switching the car controller from the CBTC system to the TACS system according to information of the second transponder; and disconnecting the car controller with an equipment in the CBTC system zone and controlling the train to exit the transition zone and to operate to the TACS system zone according to information of the third transponder.

Preferably, when the urban rail transportation fusion signaling system is deployed in the CBTC system zone, the switching the system by the car controller according to information of the transponder includes the steps of:

allowing the train to operate under the TACS system from the TACS system zone to the transition zone;

connecting the car controller with a second wayside management system in the CBTC system zone through the data communication system according the information of the third transponder, so as to obtain traffic permission information and status information of a wayside equipment;

calculating, by the car controller, the movement authorization of the train according to the traffic permission information and status information of the wayside equipment, to preform traffic control on the train;

switching the car controller from the TACS system to the CBTC system according to the information of the second transponder; and disconnecting the car controller with an equipment in the TACS system zone and controlling the train to exit the transition zone and to operate to the CBTC system zone according to the information of the first transponder.

The present invention has at least one of the following advantages:

An urban rail transportation fusion signaling system and its application method provided by the present invention can realize traffic control of the train when operating under two different systems, thereby enabling the urban rail transportation fusion signaling system with better compatibility and interoperability by fusing the first wayside management system operating under the TACS system and the second wayside management system operating under the CBTC system, and by means of the autonomous train supervision system and the car controller that can operate normally under both the TACS system and the CBTC system.

The present invention can satisfy the operation requirements of trains under two different systems (such as cross-line and co-line operation, etc.), which effectively solves the problem of difficulty and cost of line reconstruction caused by a single system that cannot satisfy long-term interoperability requirements. Besides, independent and safe operation control when the train is operating can be carried out, which greatly improves the operation efficiency and reliability of the train.

The present invention can realize the switching of the urban rail transportation fusion signaling system between the TACS system and the CBTC system on the control platform compatible with the TACS system and the CBTC system, the vehicle-mounted safety platform and the wayside safety platform, effectively reducing the cost of hardware equipment and installation space thereof.

The present invention can realize the switching between the driving mode under the TACS system and the driving mode under the CBTC system, including the autonomous driving mode, and can satisfy the general autonomous driving operation requirements of the current urban rail transportation.

DETAILED DESCRIPTION OF THE EMBODIMENTS

Figure 1:
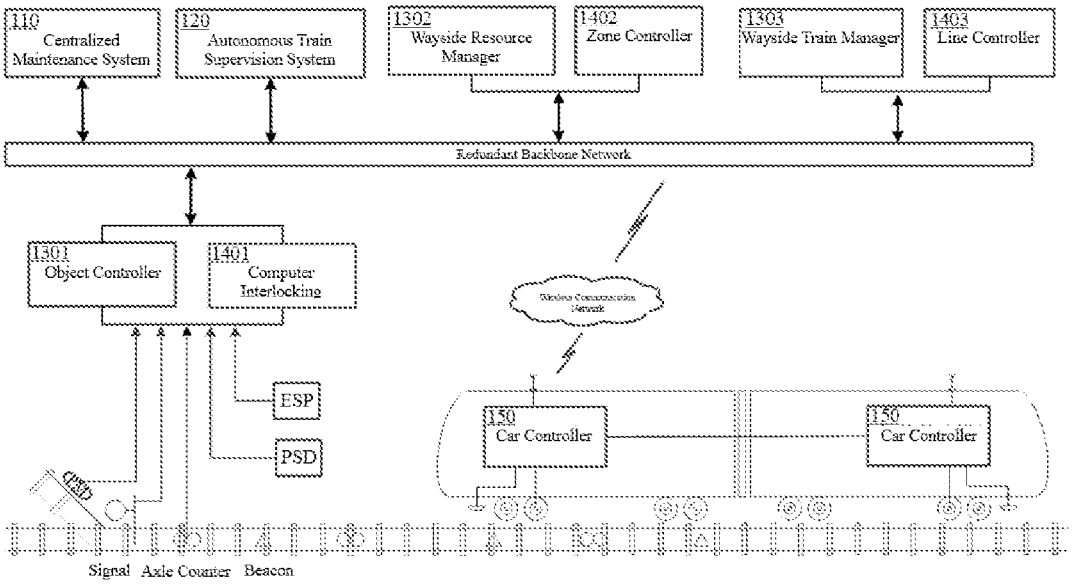
FIG. 1 is a structural diagram of an urban rail transportation fusion signaling system provided by the present embodiment.

An urban rail transportation fusion signaling system and an application method thereof proposed by the present invention will be further described in detail below in conjunction with the accompanying drawings and specific embodiments. The advantages and features of the present invention will become clearer from the following description. It should be noted that the drawings are in a very simplified form and all use imprecise scales, which are only used to facilitate and clearly assist the purpose of illustrating the embodiments of the present invention. In order to make the objects, features and advantages of the present invention more comprehensible, please refer to the accompanying drawings. It should be noted that the structures, proportions, sizes, etc. shown in the drawings attached to this specification are only used to match the content disclosed in the specification, for those who are familiar with this technology to understand and read, and are not used to limit the limiting condition of implementation of the present invention, so it has no technical substantive meaning, and any modification of structure, change of proportional relationship or adjustment of size shall still fall within the scope covered by the disclosed technical content of the present invention without affecting the effect and purpose of the present invention.

Figure 2:
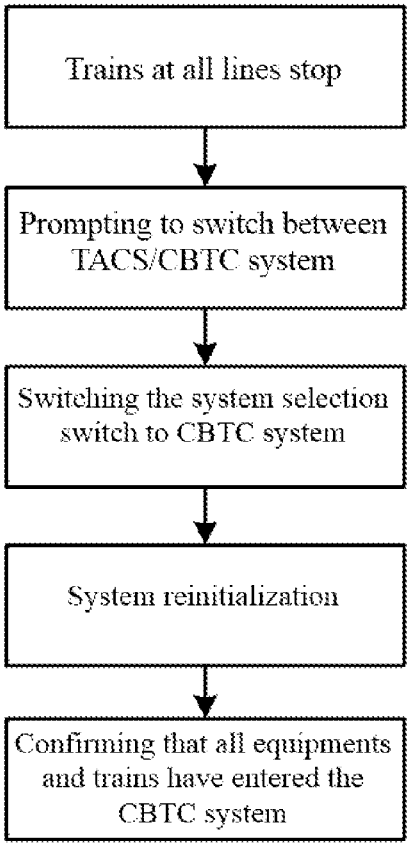
FIG. 2 is a flow chart of an urban rail transportation fusion signaling system switching from a TACS system to a CBTC system provided by the present embodiment.
Figure 3:
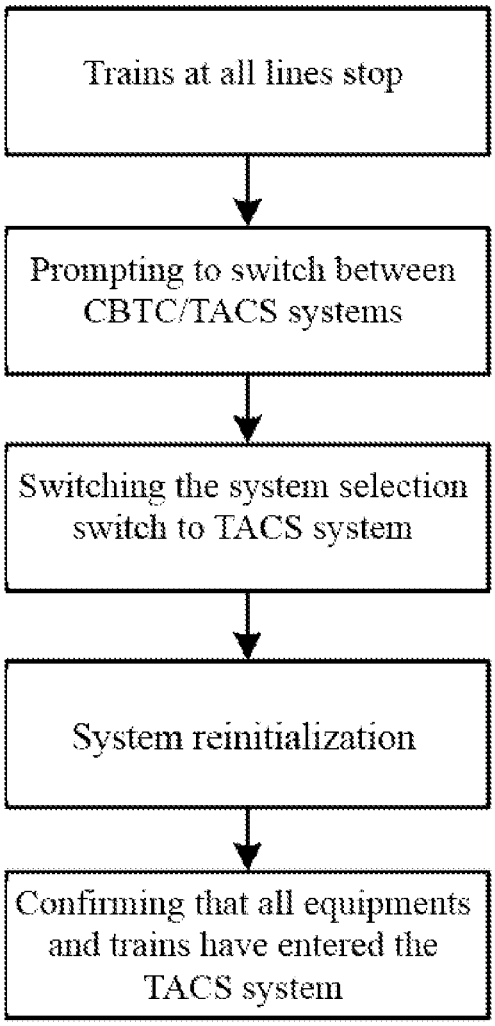
FIG. 3 is a flow chart of an urban rail transportation fusion signaling system switching from a CBTC system to a TACS system provided by the present embodiment.
Figure 4:
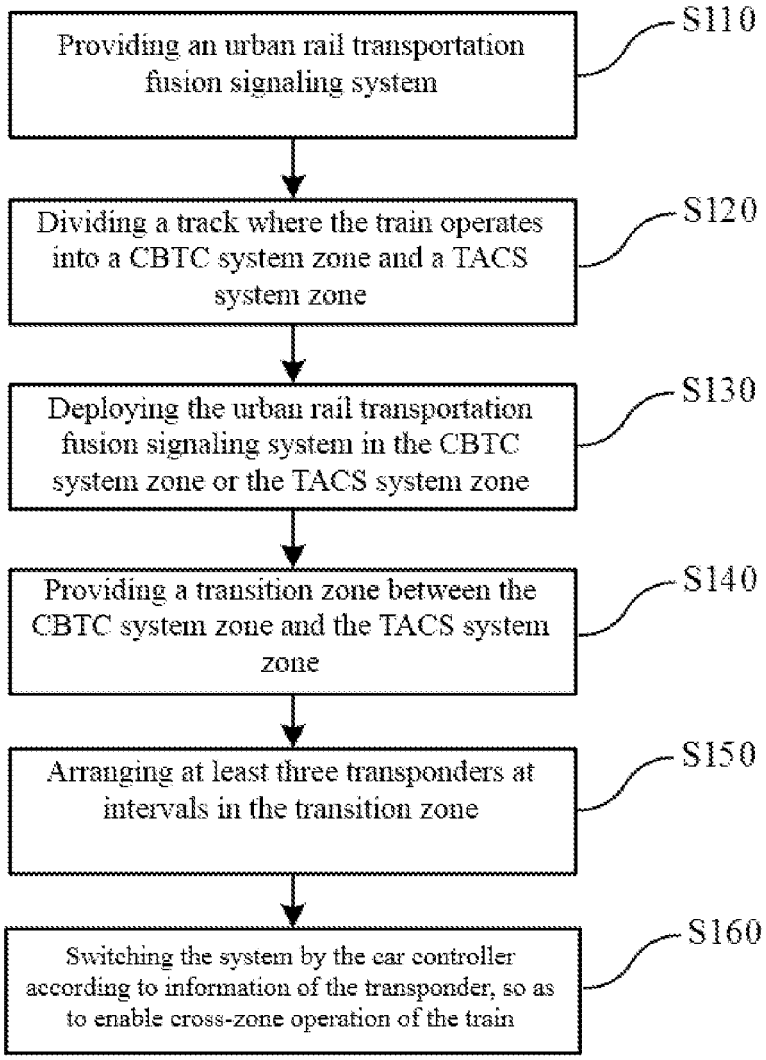
FIG. 4 is a flow chart of a method for using an urban rail transportation fusion signaling system provided in the present embodiment.

As shown in FIG. 1 to FIG. 3, an urban rail transportation fusion signaling system provided in the present embodiment, including: an autonomous train supervision system (ATS) 120, configured to send a train operation plan; a first wayside management system, operating under a TACS system and configured to generate line resource allocation information according to the train operation plan; a second wayside management system, operating under a CBTC system and configured to generate traffic permission information according to the train operation plan; and a car controller (CC) 150, provided on a rail transportation train and configured to: perform traffic control according to the line resource allocation information when the train is traveling under the TACS system; or perform traffic control according the traffic permission information when the train is traveling under the CBTC system.

Specifically, in the present embodiment, the autonomous train supervision system 120 is respectively connected to the second wayside management system and the car controller 150, configured to send a train operation plan. When the train is operating under the TACS system, the car controller 150 is connected to the first wayside management system so as to generate a line resource allocation request according to the train operation plan and send the line resource allocation request to the first wayside management system. The first wayside management system is configured to generate line resource allocation information according to the line resource allocation request and feed the line resource allocation information back to the car controller 150, so that the car controller 150 can perform traffic control. When the train is operating under the CBTC system, the car controller 150 is connected to the second wayside management system so as to send the position information of the train to the second wayside management system. The second wayside management system is configured to generate traffic permission information according to the position information of the train and the train operation plan, and feed the traffic permission information to the car controller 150, so that the car controller 150 can perform traffic control.

Please continue to refer to FIG. 1, the urban rail transportation fusion signaling system also includes: a centralized maintenance system (CMSS) 110, where the centralized maintenance system 110 is configured to perform status supervising and maintenance on the autonomous train supervision system 120, the first wayside management system, the second wayside management system and the car controller 150, and the centralized maintenance system 110 operates normally under both the TACS system and the CBTC system.

It can be understood that, in some other embodiments, the autonomous train supervision system 120 and the car controller 150 operate normally under both the TACS system and the CBTC system.

Specifically, a control platform compatible with the TACS system and the CBTC system can be provided in the dispatching control room of the station, and the autonomous train supervision system 120 and the centralized maintenance system 110 are both provided on the control platform, to facilitate the switching between the TACS system and the CBTC system for the autonomous train supervision system 120 and the centralized maintenance system 110, thereby not only satisfying the operation requirements of the train, but also effectively reducing the cost and installation space of hardware equipment in the station, but the present invention is not limited thereto.

In the present embodiment, the autonomous train supervision system 120 can supervise and autonomously manage the operation of the train (including sending the train operation plan, etc.) according to the position information of the train, where the position information of the train can be obtained from the car controller 150.

Specifically, in the present embodiment, a vehicle-mounted safety platform compatible with the TACS system and the CBTC system can be provided on the train, and the car controller 150 is provided on the control platform to facilitate the switching of the car controller 150 between the TACS system and the CBTC system, thereby effectively reducing the cost and installation space of train hardware equipment, but the present invention is not limited thereto.

Please continue to refer to FIG. 1, the first wayside management system includes: an object controller (OC) 1301, configured to perform control and status information collection on a wayside equipment; and a wayside resource manager (WSIC) 1302, configured to perform allocation and recovery of a line resource according to status information of the wayside equipment and the train operation plan, to generate the line resource allocation information.

It can be understood that, in some other embodiments, the first wayside management system further includes: a wayside train manager (WSTC) 1303; the wayside train manager 1303 is configured to temporarily limit the speed of the train.

Specifically, in the present embodiment, the first wayside management system operates normally under the TACS system, where the object controller 1301 can collect status information of the wayside equipment (including signals, axle counters, beacons, PM, ESP, PSD, etc.) and drive the wayside equipment, so that the train can operate smoothly on the track; the wayside resource manager 1302 is mainly responsible for allocation and recovery of the line resource of the train and management of the train sequence, etc., so as to ensure that the train can operate safely and orderly. The wayside train manager 1303 is mainly responsible for managing the temporary speed limit according to the location information of the train, managing and tracking the faulty train, and taking over the faulty train for resource application and release. However, the present invention is not limited thereto.

Please continue to refer to FIG. 1, the second wayside management system includes: a computer interlocking (CI) 1401, configured to perform control and status information collection on the wayside equipment; and a zone controller (ZC) 1402, configured to obtain a protection zone of the train according to location information of the train and the train operation plan, so as to generate the traffic permission information of the train.

It can be understood that, in some other embodiments, the second wayside management system further includes: a line controller (LC) 1403; and the line controller 1403 is configured to temporarily limit the speed of the train.

Specifically, in the present embodiment, the second wayside management system operates normally under the CBTC system, where the computer interlocking 1401 can collect status information of the wayside equipment (including signals, axle counters, beacons, PM, ESP, PSD, etc.) and drive the wayside equipment and be responsible for interlocking route management, so that the train can operate smoothly on the track; the zone controller 1402 can calculate a protection zone for each train, and send an authorized end point, that is, the operation permission information to each train to ensure that the train can operate safely and orderly; and the line controller 1403 is responsible for temporarily limiting the speed of the train according to the location information of the train. However, the present invention is not limited thereto.

Specifically, in the present embodiment, a wayside safety platform compatible with the TACS system and the CBTC system can be configured in the wayside signal equipment room, and the first wayside management system and the second wayside management system are all set on the wayside safety platform, so as to realize the switching between the wayside resource manager 1302 under the TACS system and the zone controller 1402 under the CBTC system on the same wayside safety platform; the switching between the wayside train manager 1303 under the TACS system and the line controller 1403 under the CBTC system, and the switching between the object controller 1301 under the TACS system and the computer interlocks 1401 under the CBTC system, thereby can not only meet the requirements of the trains running in different systems, but also reduce the economic cost and installation space of the wayside signal equipment. However, the present invention is not limited thereto.

Please continue to refer to FIG. 1, when the train operates under the TACS system, the autonomous train supervision system 120, the car controller 150, the centralized maintenance system 110, and the object controller 1301, the wayside resource manager 1302 and the wayside train manager 1303 of the first wayside management system are interconnected through a data communication system; and when the train operates under the CBTC system, the autonomous train supervision system 120, the car controller 150, the centralized maintenance system 110, and the computer interlocking 1401, the zone controller 1402 and the line controller 1403 of the second wayside management system are interconnected through the data communication system.

Specifically, in the present embodiment, the data communication system includes a redundant backbone network and a wireless communication network. When the train is operating under the TACS system, the centralized maintenance system 110 can be communicatively connected to the autonomous train supervision system 120, the centralized maintenance system 110, the object controller 1301, the wayside resource manager 1302 and the wayside train manager 1303 respectively through the redundant backbone network; the autonomous train supervision system 120 can also be communicatively connected to the car controller 150 through wireless communication network; the car controller 150 can also be communicatively connected to the wayside resource manager 1302 and the wayside train manager 1303 through wireless communication network; and the wayside resource manager 1302 can also be communicatively connected to the object controller 1301 through redundant backbone network, thereby facilitating information interaction. However, the present application is not limited thereto.

Specifically, in the present embodiment, when the train is operating under the CBTC system, the centralized maintenance system 110 can be communicatively connected to the autonomous train supervision system 120, the computer interlocking 1401, the zone controller 1402 and the line controller 1403 respectively through the redundant backbone network; the autonomous train supervision system 120 can be communicatively connected to the car controller 150 through the wireless communication network and communicatively connected to the zone controller 1402 through the redundant backbone network; and the car controller 150 can also be communicatively connected to the computer interlock 1401, the zone controller 1402 and the line controller 1403 respectively through the wireless communication network, so as to be able to communicate with each other interaction, but the present invention is not limited thereto.

Please continue to refer to FIG. 1, when the train is operating under the TACS system, the car controller 150 is configured to: send a line resource allocation request to the wayside resource manager 1302 according to the location information of the train and the train operation plan, so as to obtain the line resource allocation information, and calculate a movement authorization of the train according to the line resource allocation information and location information of an adjacent vehicle, so as to perform traffic control on the train.

Specifically, in the present embodiment, when the train is operating under the TACS system, the car controller 150 switches to the TACS system and the first wayside management system works; the autonomous train supervision system 120 sends the train operation plan to the car controller 150, and the car controller 150 can calculate a line resource requirement of the train according to the location information of the train and the train operation plan; then, according to the line resource requirement of the train, a line resource allocation request is sent to the wayside resource manager 1302; the wayside resource manager 1302 can release the line resource according to the received line resource allocation request of the train and the status information of the wayside equipment obtained from the object controller 1301, and send the specific line resource allocation information to the car controller 150; the car controller 150 can calculate the movement authorization and available driving mode of the train according to the line resource allocation information and the location information of the adjacent vehicles, so as to actively control the train operation, thereby realizing the safety protection function and autonomous driving function of the train; preferably, the autonomous driving mode includes a fully autonomous operation mode (FAM) and a creep operation mode (CAM), etc., but the present invention is not limited thereto.

Please continue to refer to FIG. 1, when the train is operating under the CBTC system, the car controller 150 is configured to: send the location information of the train to the zone controller 1402, so as to obtain the traffic permission information, and calculate the movement authorization of the train according to the traffic permission information and the status information of the wayside equipment, so as to perform traffic control on the train.

Specifically, in the present embodiment, when the train is operating under the CBTC system, the car controller 150 switches to the CBTC system, and the second wayside management system works; the autonomous train supervision system 120 sends the train operation plan to the car controller 150 and the zone controller 1402; the car controller 150 can send the location information of the train to the zone controller 1402 after receiving the train operation plan; the zone controller 1402 can generate the traffic permission information of the train according to the received train operation plan and the location information of the train, and send the traffic permission information of the train to the car controller 150; the car controller 150 calculate a movement authorization of the train and available driving mode according to the traffic permission information of the train and the status information of the wayside equipment obtained from the computer interlocking 1401, so as to perform traffic control on the train, thereby realizing the safety protection function and autonomous driving function of the train, but the invention is not limited thereto.

Specifically, in the present embodiment, according to the operation system requirements of the train, the urban rail transportation fusion signaling system can be switched between the TACS system and the CBTC system through the first human-machine interface provided in the station dispatching hall and the second human-machine interface provided on the train. More specifically, the dispatcher can switch the autonomous train supervision system 120 and the centralized maintenance system 110 between the TACS system and the CBTC system through the first human-machine interface, and switch the first wayside management system to the second wayside management system or switch the second wayside management system to the first wayside management system through the first human-machine interface; while the driver can switch the car controller 150 between the TACS system and the CBTC system through second human-machine interface. However, the present invention is not limited thereto.

More specifically, as shown in FIG. 2, the process of switching the urban rail transportation fusion signaling system from the TACS system to the CBTC system is as follows:

Step S101: the dispatcher confirms that the trains on the whole line are in a stopped state;

Step S102: the urban rail transportation fusion signaling system prompts the dispatcher and the driver to switch between TACS/CBTC systems through the first human-machine interface and the second human-machine interface, respectively;

Step S103: the dispatcher and the driver respectively switch the system selection switch on the first human-machine interface and the second human-machine interface to the CBTC system;

Step S104: the urban rail transportation fusion signaling system is reinitialized according to the state of the system selection switch;

Step S105: after the urban rail transportation fusion signaling system is initialized, the dispatcher confirms that equipment at all line (including the train autonomous supervision system, the centralized maintenance system and the second wayside management system) has entered the CBTC system and the driver confirms that the train (including car controller) has entered the CBTC system.

In the present embodiment, as shown in FIG. 3, the process of switching the urban rail transportation fusion signaling system from the CBTC system to the TACS system is as follows:

Step S201: the dispatcher confirms that the trains on the whole line are in a stopped state;

Step S202: the urban rail transportation fusion signaling system prompts the dispatcher and the driver to switch between CBTC/TACS systems through the first human-machine interface and the second human-machine interface, respectively;

Step S203: the dispatcher and the driver respectively switch the system selection switch on the first human-machine interface and the second human-machine interface to the TACS system;

Step S204: the urban rail transportation fusion signaling system is reinitialized according to the state of the system selection switch;

Step S205: after the urban rail transportation fusion signaling system is initialized, the dispatcher confirms that equipment at all line (including the train autonomous supervision system, the centralized maintenance system and the first wayside management system) has entered the TACS system and the driver confirms that the train (including car controller) has entered the TACS system.

As shown in FIG. 4 to FIG. 8, an application method for using the urban rail transportation fusion signaling system is further provided by the present embodiment, including: step S110, providing the above-mentioned urban rail transportation fusion signaling system; step S120, dividing a track where the train operates into a CBTC system zone and a TACS system zone; Step S130, deploying the urban rail transportation fusion signaling system in the CBTC system zone or the TACS system zone; Step S140, providing a transition zone between the CBTC system zone and the TACS system zone; step S150, arranging at least three transponders at intervals in the transition zone; and step S160, switching the system by the car controller according to information of the transponder, so as to enable cross-zone operation of the train between the CBTC system zone and the TACS system zone.

Figure 5:
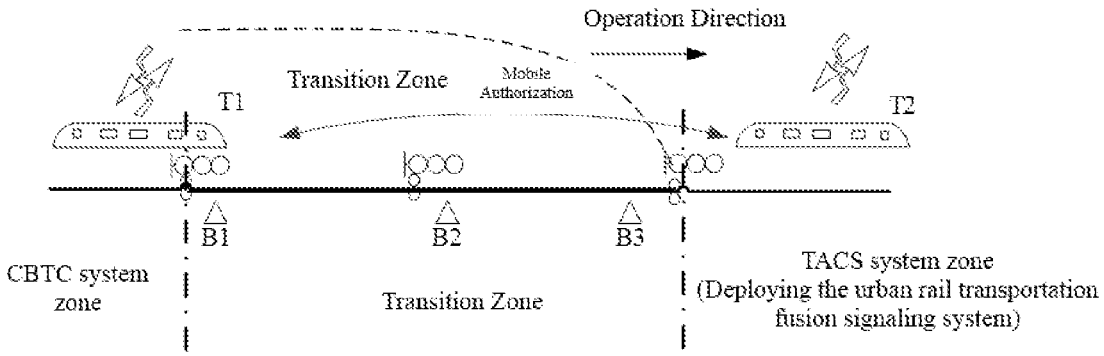
FIG. 5 is a schematic diagram of a cross-zone operation of a train from a CBTC system zone to a TACS system zone in an urban rail transportation fusion signaling system provided by the present embodiment.
Figure 6:
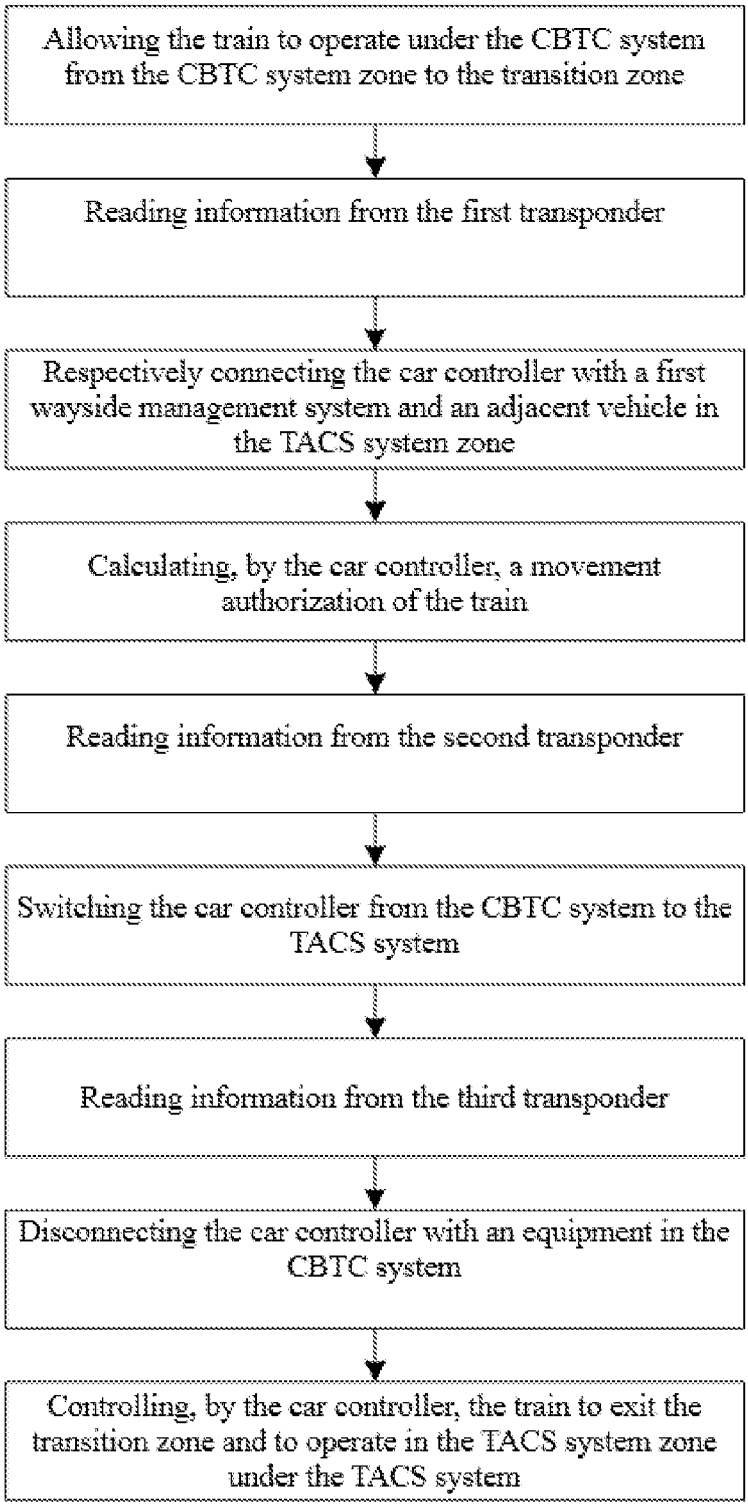
FIG. 6 is a flow chart of a cross-zone operation of a train from a CBTC system zone to a TACS system zone in an urban rail transportation fusion signaling system provided by the present embodiment.

Please refer to FIG. 5 and FIG. 6 at the same time, when the urban rail transportation fusion signaling system is deployed in the TACS system zone, the step S160 includes:

the train T1 operates under the CBTC system from the CBTC system zone to the transition zone; according to the information of the first transponder B1, the car controller 150 is respectively connected with the first wayside management system and an adjacent vehicle T2 in the TACS system zone through the data communication system, so as to obtain line resource allocation information and the location information of the adjacent vehicle; according to the line resource allocation information and the location information of the adjacent vehicle, the car controller 150 calculates the movement authorization of the train T1, so as to perform traffic control on the train T1; according to the information of the second transponder B2, the car controller 150 switches from the CBTC system to the TACS system; and according to the information of the third transponder B3, the car controller 150 disconnects from the connection of equipment in the CBTC system zone, and control the train T1 to leave the transition zone to operate to the TACS system zone.

Specifically, in the present embodiment, when the train T1 operates from the CBTC system zone to the TACS system zone with the urban rail transportation fusion signaling system, the car controller 150 will first read the information of the first transponder B1 after the train T1 enters the transition zone; at this time, the car controller 150 starts to establish a communication connection with the first wayside management system of the TACS system zone and send a line resource allocation request to the first wayside management system to obtain the line resource allocation information, while the car controller 150 also starts to establish a communication connection with the adjacent vehicle T2 in the TACS system zone and obtains the location information of the adjacent vehicle T2; then the car controller 150 calculates the movement authorization of the train T1 and the available driving modes; when the train T1 continues to move forward, the car controller 150 reads the information of the second transponder B2; at this time, the car controller 150 will prompt the driver to switch CBTC/TACS on the second human-machine interface; when the train T1 stops or does not stop, the driver can switch the car controller 150 from the CBTC system to the TACS system, and select corresponding driving modes, including autonomous driving mode; at this time, the car controller 150 controls the train in the driving mode under the TACS system and exits the driving mode under the CBTC system; when the train T1 continues to move forward, the car controller 150 reads the information of the third transponder B3; at this time, the car controller 150 will disconnect the communication connection with the equipment in the original CBTC system zone, and control the train T1 to leave the transition zone, and operate in the TACS system zone in the driving mode under the TACS system, so as to realize the cross zone operation of the train T1 from the CBTC system zone to the TACS system zone, and thus satisfy the operation requirements of the train T1 under two different systems (such as cross line and co line operation); preferably, all the transponders are used to identify the time point when the train takes corresponding actions in the transition zone, but the present invention is not limited thereto.

Figure 7:
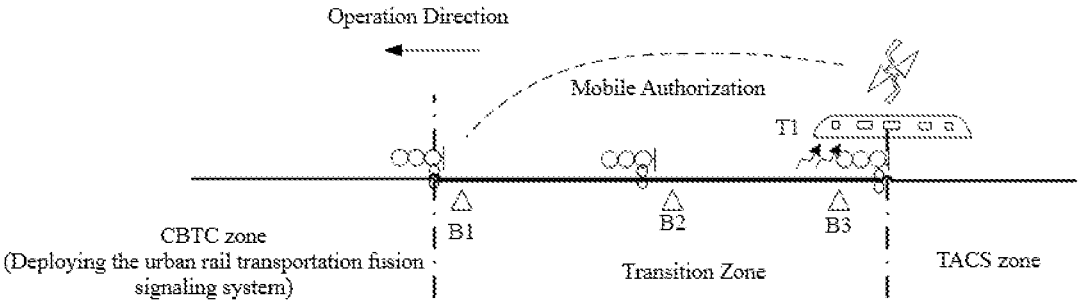
FIG. 7 is a schematic diagram of a cross-zone operation of a train from a TACS system zone to a CBTC system zone in an urban rail transportation fusion signaling system provided by the present embodiment.
Figure 8:
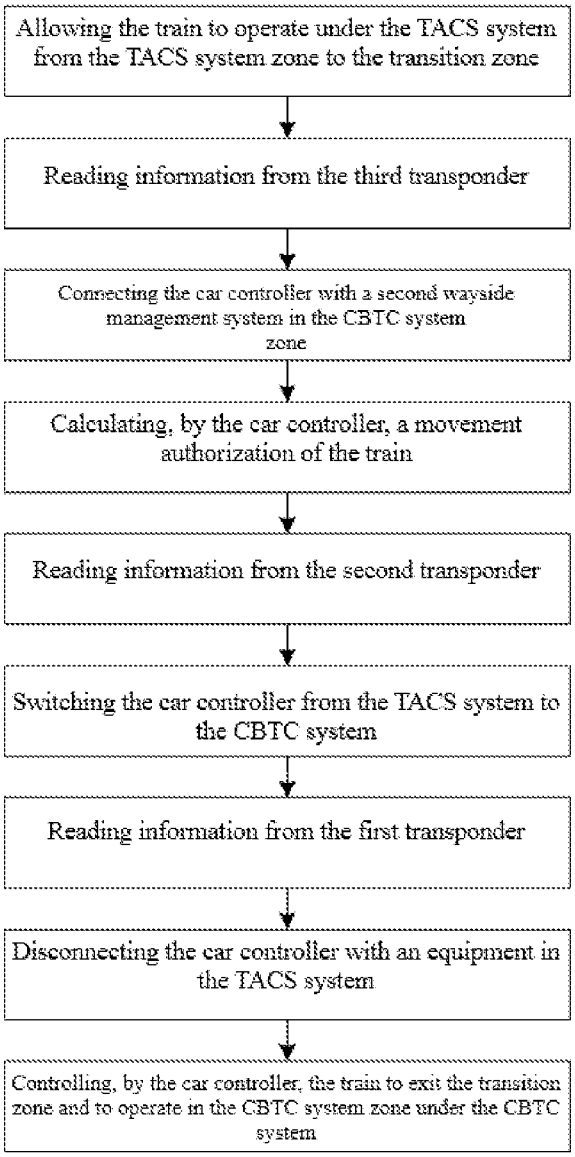
FIG. 8 is a flowchart of a cross-zone operation of a train from a TACS system zone to a CBTC system zone in an urban rail transportation fusion signaling system provided by the present embodiment.

Please refer to FIG. 7 and FIG. 8 at the same time, when the urban rail transportation fusion signaling system is deployed in the CBTC system zone, the step S160 includes: the train T1 operates under the TACS system from the TACS system zone to the transition zone; according to the information of the third transponder B3, the car controller 150 is connected with the second wayside management system in the CBTC system zone through the data communication system, so as to obtain status information of the wayside equipment and operation permission information; according to the status information of the wayside equipment and the operation permission information, the car controller 150 calculates the movement authorization of the train, so as to perform traffic control on the train T1; according to the information of the second transponder B2, the car controller 150 switches from the TACS system to the CBTC system; and according to the information of the first transponder B1, the car controller 150 disconnects from the connection of equipment in the TACS system zone, and control the train T1 to leave the transition zone to operate to the CBTC system zone.

Specifically, in the present embodiment, when the train T1 operates from the TACS system zone to the CBTC system zone with the urban rail transportation fusion signaling system, the car controller 150 will first read the information of the third transponder B3 after the train T1 enters the transition zone; at this time, the car controller 150 starts to establish a communication connection with the second wayside management system of the CBTC system zone and sends a location information of the train T1 to the second wayside management system to obtain the status information of the wayside equipment and the operation permission information; then the car controller 150 calculates the movement authorization of the train T1 and the available driving modes; when the train T1 continues to move forward, the car controller 150 reads the information of the second transponder B2; at this time, the car controller 150 will prompt the driver to switch TACS/CBTC on the second human-machine interface. When the train T1 stops or does not stop, the driver can switch the car controller 150 from the TACS system to the CBTC system, and select corresponding driving modes, including autonomous driving mode; at this time, the car controller 150 controls the train in the driving mode under the CBTC system and exits the driving mode under the TACS system; when the train T1 continues to move forward, the car controller 150 reads the information of the first transponder B1; at this time, the car controller 150 will disconnect the communication connection with the equipment in the original TACS system zone, and control the train T1 to leave the transition zone, and operate in the CBTC system zone in the driving mode under the CBTC system, so as to realize the cross zone operation of the train T1 from the TACS system zone to the CBTC system zone, and thus satisfy the operation requirements of the train T1 under two different systems (such as cross line and co line operation), but the present invention is not limited thereto.

In the present embodiment, an application method for using the urban rail transportation fusion signaling system can also be provided, that is, when the train is operating in the TACS system zone to the CBTC system zone where the urban rail transportation fusion signaling system is deployed, the urban rail transportation fusion signaling system can be switched to the TACS system, so that the train can continue to operate in the CBTC system zone with the TACS system. When the train is operating in the CBTC system zone to the TACS system zone where the urban rail transportation fusion signaling system is deployed, the urban rail transportation fusion signaling system can be switched to the CBTC system, so that the train can continue to operate in the TACS system zone with the CBTC system. However, the present invention is not limited thereto.

To sum up, the urban rail transportation fusion signaling system and its application method provided by provided by the present embodiment can realize traffic control of the train when operating under two different systems, thereby enabling the urban rail transportation fusion signaling system with better compatibility and interoperability by fusing the first wayside management system operating under the TACS system and the second wayside management system operating under the CBTC system, and by means of the autonomous train supervision system and the car controller that can operate normally under both the TACS system and the CBTC system, so that the operation requirements of trains under two different systems (such as cross-line and co-line operation, etc.) can be satisfied, which effectively solves the problem of difficulty and cost of line reconstruction caused by a single system that cannot satisfy long-term interoperability requirements. Besides, the present invention can realize the switching between the driving mode under the TACS system and the driving mode under the CBTC system, including the autonomous driving mode, and can satisfy the general autonomous driving operation requirements of the current urban rail transportation.

It should be noted that in this specification, relational terms such as the first and second are only used to distinguish one entity or operation from another entities or operations, and do not necessarily require or imply that there is any such actual relationship or order between these entities or operations. Furthermore, the term "comprises", "includes" or any other variant thereof are intended to cover non-exclusive inclusion, so that a process, method, object or equipment including a series of elements not only includes those elements, but also includes other elements not explicitly listed, or also includes elements inherent to such process, method, object or equipment. Without further limitations, an element defined by the phrase "comprising a . . . " does not exclude the presence of additional identical elements in the process, method, object or equipment including the element.

In the description of the present invention, it should be understood that the terms "center", "height", "thickness", "upper", "lower", "vertical", "horizontal", "top", "bottom", "inside", "outside", "axial", "radial", "circumferential" and other directions or positional relationships indicated are those based on the directions or positional relationships shown in the drawings, only for the convenience of describing the present invention and simplifying the description, instead of indicating or implying that the equipment or element referred to must have a specific orientation, be constructed and operate in a specific orientation, it cannot be understood as a limitation of the present invention. In the description of the present invention, unless otherwise specified, "plurality" means two or more.

In the description of the present invention, unless otherwise specified and limited, the terms "mounting", "connecting", "connection" and "fixing" should be understood in a broad sense, for example, they may be a fixed connection, a detachable connection, or formed integrally connection; they may be a mechanical connection, or may be an electrical connection; may be a direct connection and may also be an indirect connection via an intermediate medium, or may be communication between the interiors of two elements or the interaction between two components. Those of ordinary skill in the art can understand the specific meanings of the above terms in the present invention in specific situations.

In the present invention, unless otherwise specified and defined, the first feature "above" or "below" the second feature may include direct contact between the first and second features, or contact between the first and second features through other features instead of direct contact. Moreover, the first feature "on", "above" and "over" the second feature include that the first feature is directly above and obliquely above the second feature, or only indicates that the horizontal height of the first feature is higher than the second feature. Moreover, the first feature "under", "below" and "beneath" the second feature include that the first feature is directly under and obliquely under the second feature, or only indicates that the horizontal height of the first feature is lower than the second feature.

Although the content of the present invention has been described in detail through the above preferred embodiments, it should be understood that the above description should not be considered as limiting the present invention. Various modifications and alterations to the present invention will become apparent to those skilled in the art upon reading the above disclosure. Therefore, the protection scope of the present invention should be defined by the appended claims.

The invention claimed is:

1. An urban rail transportation fusion signaling system, comprising:

an autonomous train supervision system, configured to send a train operation plan;

a first wayside management system, operating under a Train Autonomous Circumambulate System (TACS) system and configured to generate line resource allocation information according to the train operation plan;

a second wayside management system, operating under a Communications-Based Train Control (CBTC) system and configured to generate operation permission information according to the train operation plan; and a car controller, provided on a rail transportation train and configured to: perform traffic control according to the line resource allocation information when the train is traveling under the TACS system; or perform traffic control according to the operation permission information when the train is traveling under the CBTC system;

wherein the second wayside management system comprises:

a computer interlocking configured to perform control and status information collection on a wayside equipment;

a zone controller configured to obtain a protection zone of the train according to location information of the train and the train operation plan, so as to generate the operation permission information of the train; and a line controller configured to temporarily limit a speed of the train.

2. The urban rail transportation fusion signaling system according to claim 1, wherein:

the autonomous train supervision system and the car controller operate normally under both the TACS system and the CBTC system.

3. The urban rail transportation fusion signaling system according to claim 2, wherein the first wayside management system comprises:

an object controller, configured to perform control and status information collection on the wayside equipment; and a wayside resource manager, configured to perform allocation and recovery of a line resource according to the status information of the wayside equipment and the train operation plan.

4. The urban rail transportation fusion signaling system according to claim 3, wherein:

when the train is operating under the TACS system, the car controller is configured to: send a line resource allocation request to the wayside resource manager according to the location information of the train and the train operation plan, so as to obtain the line resource allocation information, and calculate a movement authorization of the train according to the line resource allocation information and location information of an adjacent vehicle, so as to perform traffic control on the train.

5. The urban rail transportation fusion signaling system according to claim 1, wherein:

when the train is operating under the CBTC system, the car controller is configured to: send the location information of the train to the zone controller, so as to obtain the operation permission information, and calculate a movement authorization of the train according to the operation permission information and the status information of the wayside equipment, so as to perform traffic control on the train.

6. The urban rail transportation fusion signaling system according to claim 1, further comprising: a centralized maintenance system, wherein the centralized maintenance system is configured to perform status supervising and maintenance on the autonomous train supervision system, the first wayside management system, the second wayside management system and the car controller, and the centralized maintenance system operates normally under both the TACS system and the CBTC system.

7. The urban rail transportation fusion signaling system according to claim 6, wherein:

the first wayside management system further comprises: a wayside train manager, and the wayside train manager is configured to temporarily limit the speed of the train.

8. The urban rail transportation fusion signaling system according to claim 7, wherein:

when the train operates under the TACS system, the autonomous train supervision system, the car controller, the centralized maintenance system, and an object controller, a wayside resource manager and the wayside train manager of the first wayside management system are interconnected through a data communication system; and when the train operates under the CBTC system, the autonomous train supervision system, the car controller, the centralized maintenance system, the computer interlocking, the zone controller, and the line controller of the second wayside management system are interconnected through the data communication system.

9. A method for using an urban rail transportation fusion signaling system, comprising:

providing the urban rail transportation fusion signaling system according to claim 1;

dividing a track where the train operates into a Communications-Based Train Control (CBTC) system zone and a Train Autonomous Circumambulate System (TACS) system zone;

deploying the urban rail transportation fusion signaling system in the CBTC system zone or the TACS system zone;

providing a transition zone between the CBTC system zone and the TACS system zone;

arranging at least three transponders at intervals in the transition zone; the at least three transponders comprise a first transponder, a second transponder, and a third transponder; and switching from the CBTC system to the TACS system or switching from the TACS system to the CBTC system by the car controller according to information of the transponders, so as to enable cross-zone operation of the train between the CBTC system zone and the TACS system zone.

10. The method for using an urban rail transportation fusion signaling system according to claim 9, wherein when the urban rail transportation fusion signaling system is deployed in the TACS system zone, the switching from the CBTC system to the TACS system or switching from the TACS system to the CBTC system by the car controller according to information of the transponders comprises the steps of:

allowing the train to operate under the CBTC system from the CBTC system zone to the transition zone;

respectively connecting the car controller with a first wayside management system and an adjacent vehicle in the TACS system zone through a data communication system according to information of the first transponder, so as to obtain line resource allocation information and location information of the adjacent vehicle;

calculating, by the car controller, a movement authorization of the train according to the line resource allocation information and the location information of the adjacent vehicle, so as to perform traffic control on the train;

switching the car controller from the CBTC system to the TACS system according to information of the second transponder; and disconnecting the car controller with an equipment in the CBTC system zone and controlling the train to exit the transition zone and to operate to the TACS system zone according to information of the third transponder.

11. The method for using an urban rail transportation fusion signaling system according to claim 9, wherein when the urban rail transportation fusion signaling system is deployed in the CBTC system zone, the switching from the CBTC system to the TACS system or switching from the TACS system to the CBTC system by the car controller according to information of the transponders comprises the steps of:

allowing the train to operate under the TACS system from the TACS system zone to the transition zone;

connecting the car controller with a second wayside management system in the CBTC system zone through a data communication system according to information of the third transponder, so as to obtain operation permission information and status information of a wayside equipment;

calculating, by the car controller, a movement authorization of the train according to the operation permission information and status information of the wayside equipment, to perform traffic control on the train;

switching the car controller from the TACS system to the CBTC system according to the information of the second transponder; and disconnecting the car controller with an equipment in the TACS system zone and controlling the train to exit the transition zone and to operate to the CBTC system zone according to the information of the first transponder.

* * * * *